US009630409B2

(12) United States Patent
Hamada et al.

(10) Patent No.: US 9,630,409 B2
(45) Date of Patent: Apr. 25, 2017

(54) LIQUID DISCHARGE HEAD

(71) Applicant: CANON KABUSHIKI KAISHA, Tokyo (JP)

(72) Inventors: Yoshihiro Hamada, Yokohama (JP); Masaki Oikawa, Inagi (JP); Hiroshi Yamada, Yokohama (JP); Atsushi Omura, Kawasaki (JP); Takuma Kodoi, Kawasaki (JP); Tomotsugu Kuroda, Yokohama (JP); Tomoyuki Tenkawa, Yokohama (JP); Monta Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/215,044

(22) Filed: Jul. 20, 2016

(65) Prior Publication Data

US 2017/0021621 A1 Jan. 26, 2017

(30) Foreign Application Priority Data

Jul. 24, 2015 (JP) ..... 2015-146459

(51) Int. Cl.
*B41J 2/14* (2006.01)

(52) U.S. Cl.
CPC ..... *B41J 2/1433* (2013.01); *B41J 2/1404* (2013.01); *B41J 2/14016* (2013.01); *B41J 2/14145* (2013.01); *B41J 2202/07* (2013.01)

(58) Field of Classification Search
CPC ..... B41J 2/19; B41J 2/1433; B41J 2/14145; B41J 2/14016; B41J 2/1404; B41J 2202/07
See application file for complete search history.

(56) References Cited

U.S. PATENT DOCUMENTS 6,109,734 A * 8/2000 Kashino ..... B41J 2/055 347/65

FOREIGN PATENT DOCUMENTS

JP 2006-240150 A 9/2006

* cited by examiner

*Primary Examiner* — Geoffrey Mruk
(74) *Attorney, Agent, or Firm* — Canon U.S.A. Inc., IP Division

(57) ABSTRACT

A liquid discharge head includes a print element substrate provided with discharge ports, through which liquid is discharged; and a support member having a liquid chamber, which is provided with a communicating opening that communicates with the discharge ports, wherein the liquid chamber has a first surface provided with the communicating opening, and a second surface facing the first surface, the second surface is provided with a buffer chamber, which is a hollow space for storing gas, and the buffer chamber has, in the second surface, an opening having a projecting portion projecting toward the inner side of the opening.

13 Claims, 9 Drawing Sheets

LIQUID DISCHARGE HEAD

BACKGROUND OF THE INVENTION

Field of the Invention

The present invention relates to a liquid discharge head.

Description of the Related Art

Liquid discharge heads that discharge liquid, such as ink, are known. In a liquid discharge head, a print element substrate having discharge port rows is mounted on a support member, and a liquid chamber inside the support member and supply ports, which are provided in the print element substrate so as to correspond to the respective discharge port rows, are connected to each other, forming liquid flow paths that are continuous from the liquid chamber to discharge ports. In recent years, due to the demand for high-speed recording, the number of discharge ports arranged in the liquid discharge head has been increased, and a flow path design that enables liquid to be supplied at a high flow rate is required.

Because liquid discharge heads handle fluid, such as ink, vibration of liquid causes menisci to vibrate at the discharge ports, which may deteriorate the discharge accuracy. The meniscus vibration tends to occur in liquid discharge heads that have a large number of discharge ports arranged in a high density and that have high liquid flow rates per unit time.

For example, when liquid discharge from the plurality of discharge ports is stopped at once, the inertial force that causes the liquid to move forward of the discharge ports increases, pushing out the liquid in the discharge ports and extruding out the menisci inside the discharge ports. Meanwhile, a typical liquid tank, which supplies liquid, is configured to be maintained at a negative pressure to prevent dripping of liquid from the supply port. Hence, the liquid supplied from the liquid tank is subjected to a force that tends to pull the liquid back to the upstream side (liquid tank side). Therefore, the liquid with the menisci extruding out at the discharge ports, as described above, subsequently tends to retract in to the opposite side.

As has been described, when the discharge is stopped, so-called meniscus vibration, in which menisci extrude out and retract in at the discharge ports, is induced. This vibration becomes large as the liquid flow rate per unit time increases.

When the subsequent discharge is performed in a state in which the menisci extrude out, fine ink droplets are splashed, whereas, when the subsequent discharge is performed in a state in which the menisci retract in, the discharge speed and the amount of discharge decrease. In either case, defective discharge, such as discharge irregularity, occur.

Furthermore, in a state in which the discharge is stopped, when liquid discharge from the plurality of discharge ports is started at once, the liquid starts to move from the stationary state. Therefore, after the first discharge of liquid, the inertial force that causes the liquid to move forward of the discharge ports may not be increased to a magnitude sufficient to fully fill the discharge ports with the liquid. Thus, when the subsequent discharge is started in a state in which the menisci in the discharge ports retract in, defective discharge, such as discharge irregularity, occur.

Japanese Patent Laid-Open No. 2006-240150 discloses a liquid discharge head in which meniscus vibration at discharge ports can be reduced. The liquid discharge head disclosed in Japanese Patent Laid-Open No. 2006-240150 has, in a liquid chamber, a buffer chamber that stores gas (for example, bubble). By using the gas in the buffer chamber, the meniscus vibration at discharge ports is absorbed and attenuated.

In recent years, demands for high image quality and reliability are more and more increasing. Under the circumstances, if liquid has been discharged or has not been discharged for a long time, gas dissolved in liquid, gas taken in after passing through a housing of a liquid discharge head, or the like may be combined with the gas in the buffer chamber, increasing the volume of the gas in the buffer chamber. As a result, the gas in the buffer chamber may expand until it reaches the discharge ports and the vicinity thereof. In this state, the expanded gas blocks the liquid flow paths, preventing the liquid from being supplied to the discharge ports and causing defective discharge.

The present invention provides a liquid discharge head in which the meniscus vibration at discharge ports is suppressed and in which defective discharge can be reduced.

SUMMARY OF THE INVENTION

A liquid discharge head includes a print element substrate provided with discharge ports, through which liquid is discharged; and a support member having a liquid chamber, which is provided with a communicating opening that communicates with the discharge ports, wherein the liquid chamber has a first surface provided with the communicating opening, and a second surface facing the first surface, the second surface is provided with a buffer chamber, which is a hollow space for storing gas, and the buffer chamber has, in the second surface, an opening having a projecting portion projecting toward the inner side of the opening.

Further features of the present invention will become apparent from the following description of exemplary embodiments with reference to the attached drawings.

DESCRIPTION OF THE EMBODIMENTS

Referring to the attached drawings, embodiments of the present invention will be described in detail below.

Outline of Liquid Discharge Head

Figure 1A:
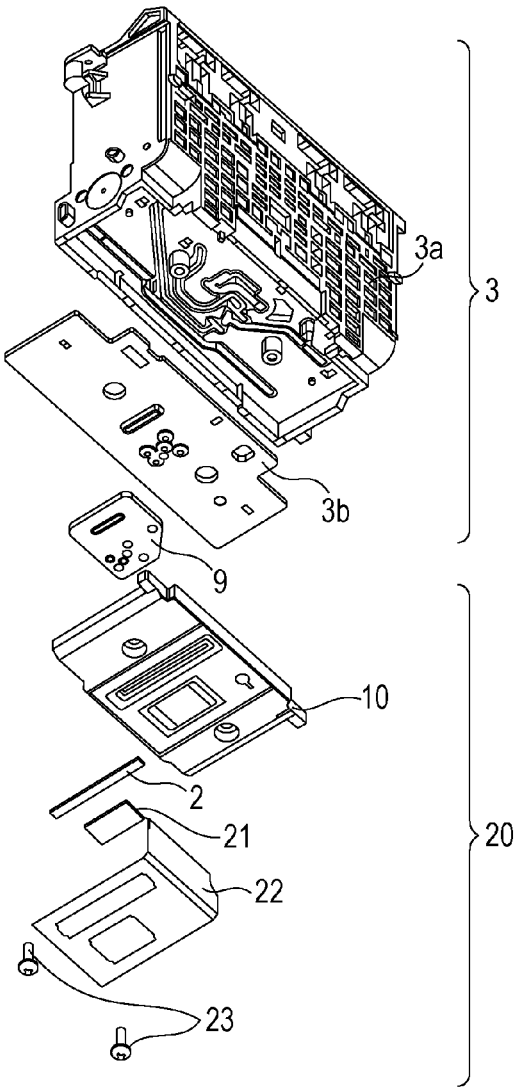
FIGS. 1A and 1B show a liquid discharge head according to embodiments of the present invention.
Figure 1B:
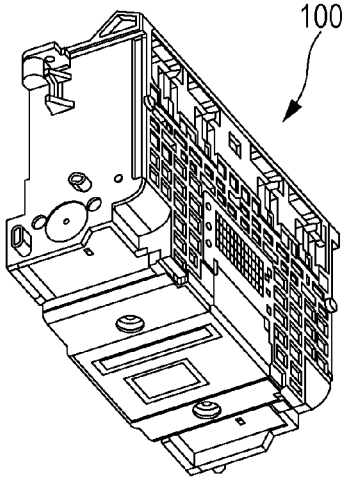

Embodiments of the present invention may be applied to a liquid discharge head 100, which has a configuration as shown in FIGS. 1A and 1B. Herein, ink is used as an example of liquid.

FIGS. 1A and 1B are external perspective views of the liquid discharge head 100 according to this embodiment, in which FIG. 1A is an exploded perspective view, and FIG. 1B is an assembled perspective view.

In FIGS. 1A and 1B, a housing 3*a,* which holds an ink tank (not shown), and a flow path plate 3*b* are joined together by, for example, welding, thus forming a liquid flow path unit 3.

A print element substrate 2, which discharges black ink and has a discharge port row having a length of about 1 inch, and a print element substrate 21, which discharges color ink and has six discharge port rows having a length of about 0.5 inches, are positioned and joined relative to the support member 10. The discharge port row in the print element substrate 2 is formed of a plurality of discharge ports arranged in the longitudinal direction of the print element substrate 2. The six discharge port rows in the print element substrate 21 are each formed of a plurality of discharge ports arranged in the longitudinal direction of the print element substrate 21.

Next, an electric wiring substrate 22 is positioned and joined relative to the support member 10, and the wires of the electric wiring substrate 22 are joined to the print element substrates 2 and 21, thus forming a liquid discharge unit 20.

Next, the liquid flow path unit 3 and the liquid discharge unit 20 are joined together with screws 23, with a joint member 9 disposed therebetween. The electric wiring substrate 22 is fixed to the housing 3*a* and joined to a wiring substrate (not shown) of a liquid discharge device body, thus forming the liquid discharge head 100 shown in FIG. 1B.

First Embodiment

A first embodiment of the present invention will be described below. In the first embodiment, components having the same configurations as those of the liquid discharge head 100 shown in FIGS. 1A and 1B will be described using the same reference signs.

This embodiment will be described with reference to FIGS. 2A to 5C.

Figure 2A:
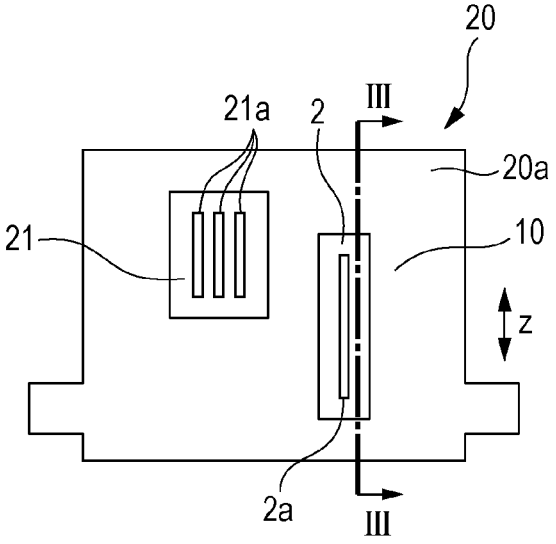
FIGS. 2A and 2B show the configuration of a part of the liquid discharge head according to a first embodiment of the present invention.

FIG. 2A is a plan view of the liquid discharge unit 20 in the liquid discharge head according to this embodiment, as viewed from a discharge port surface 20*a,* in which discharge port rows 2*a* and 21*a* are provided. The discharge port rows 2*a* and 21*a* are provided in the print element substrates 2 and 21, respectively. In FIG. 2A, three of the six discharge port rows 21*a* in the print element substrate 21 are shown.

Figure 2B:
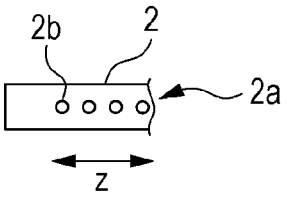

FIG. 2B shows a portion of the discharge port row 2*a,* serving as an example of a discharge port row. The discharge port row 2*a* is formed of a plurality of discharge ports 2*b* arranged in the longitudinal direction Z of the print element substrate 2.

Figure 3:
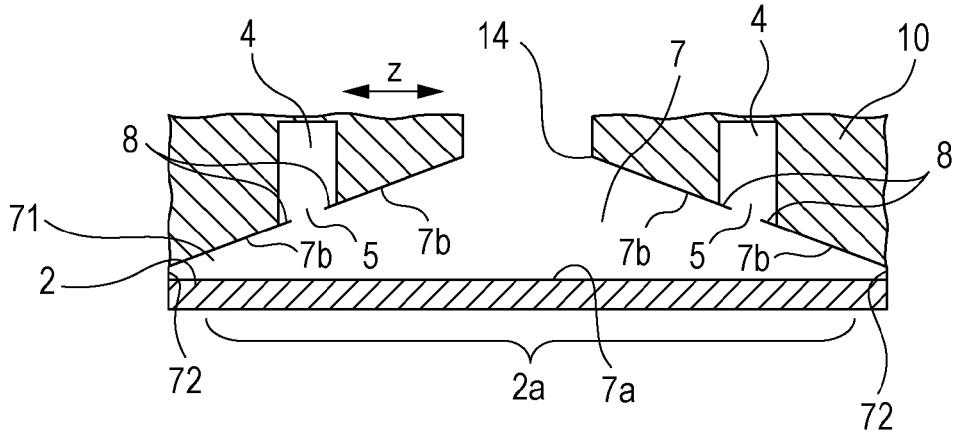
FIG. 3 is a sectional view showing the inside structure of the liquid discharge head according to the first embodiment of the present invention.
Figure 4:
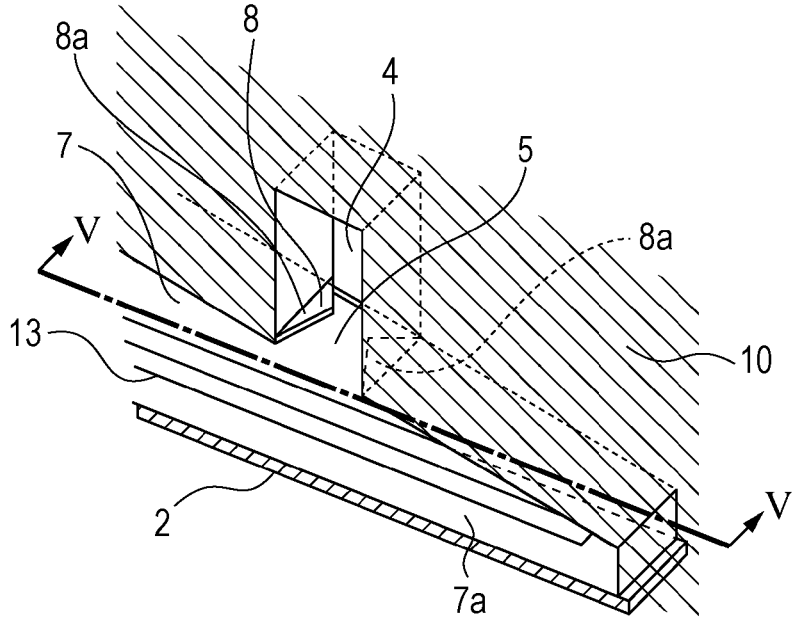
FIG. 4 is a sectional view showing the inside structure of the liquid discharge head according to the first embodiment of the present invention.

FIG. 3 is a sectional view taken along line III-III in FIG. 2A. Line III-III is parallel to the longitudinal direction Z. FIG. 4 is a sectional perspective view showing a buffer chamber 4 and the vicinity thereof in the support member 10. The buffer chamber 4 stores bubble inside.

As shown in FIGS. 3 and 4, the support member 10 is provided with a liquid chamber 7. The longitudinal direction of the liquid chamber 7 is the longitudinal direction, Z, of the print element substrate 2. The liquid chamber 7 stores ink to be supplied to the print element substrate 2. The liquid chamber 7 has a surface 7*a,* in which a through-opening 13 communicating with the discharge ports 2*b* in the print element substrate 2 is provided, and surfaces 7*b* that face the surface 7*a*. The surface 7*a* is an example of a first surface, and the surfaces 7*b* are an example of a second surface. The through-opening 13 is an example of a communicating opening. The surfaces 7*b* are provided with an ink inlet 14 and buffer chambers 4, which are the spaces for storing gas. The distance between the surfaces 7*b* and the surface 7*a* decreases as the distance between the inflow port 14 and ends 72 of the liquid chamber 7 increases.

Each buffer chamber 4 is provided with two plate-like projections 8*a* at the end on the surface 7*b* side. The projections 8*a* project toward the inner side of an opening 5 of the buffer chamber 4 in the surface 7*b*. Thus, the opening 5 is formed so as to have projecting portions 8 projecting toward the inner side of the opening 5. Furthermore, the opening 5 is partially narrowed in the width direction, which is perpendicular to the longitudinal direction, of the liquid chamber 7. In this embodiment, the opening 5 is formed so as to have the two projecting portions 8 projecting toward the center of the opening 5.

Ink flowing out of the ink tank attached to the liquid flow path unit 3 flows through the flow path plate 3*b* and the joint member 9 into the liquid chamber 7, from the inflow port 14. When the ink is charged into the liquid chamber 7, the buffer chambers 4 are not filled with the ink, and air remains therein. The surfaces 7*b* of the liquid chamber 7 are inclined relative to the surface 7*a* so that bubbles (gas) are not accumulated in the liquid chamber 7. The surfaces 7*b* may be either smoothly tapered or stepped to an extent that does not inhibit the flow of ink and bubbles (gas).

The ink charged into the liquid chamber 7 is charged, through the through-opening 13, into a large number of pressure chambers (not shown), which have the discharge port row 2*a* and print elements (not shown). The print elements are, for example, heating resistance elements or piezoelectric elements. By selectively driving predetermined print elements in the pressure chambers, ink is discharged from the discharge ports 2*b*.

In this embodiment, 1280 discharge ports 2*b,* each of which discharges 12 pl of droplet, are arranged at a density of 1200 dpi in the print element substrate 2, and the maximum discharge frequency at the discharge ports 2*b* is 24 kHz. Therefore, the liquid discharge head according to this embodiment may be installed in a printing apparatus that discharges ink at a flow rate of 22 ml/min by discharging ink from all the discharge ports.

Next, a method for removing air, which is gas protruding out of the buffer chambers 4 (hereinbelow referred to as "buffer spillover bubbles"), will be described.

Figure 5A:
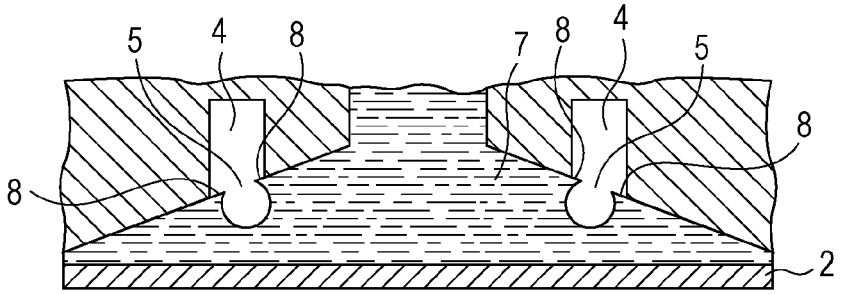
FIGS. 5A to 5C are sectional views showing the inside structure of the liquid discharge head according to the first embodiment of the present invention.
Figure 5B:
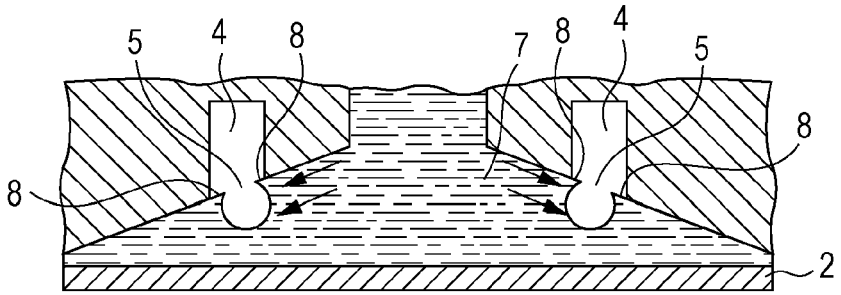
Figure 5C:
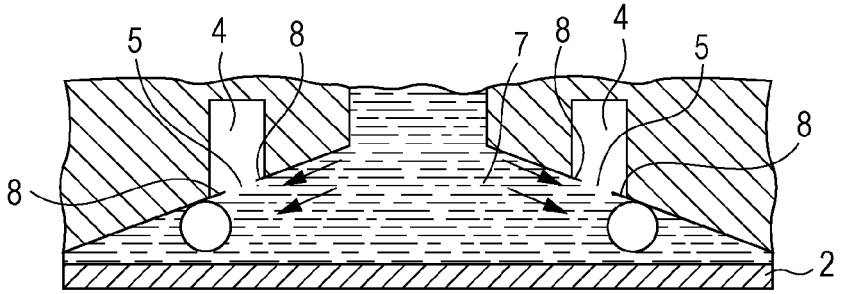

FIGS. 5A to 5C are sectional views taken along line V-V in FIG. 4. Although the liquid chamber 7 is filled with ink, the buffer chambers 4 accommodate air. The air in the buffer chambers 4 functions as air buffers, which reduce the meniscus vibration occurring at the discharge ports 2*b* due to ink discharge.

However, if the liquid discharge unit 20 has been used or has not been used for a long time, bubbles (gas) released into the ink from the components of the liquid flow path unit 3 or the liquid discharge unit 20 or bubbles (gas) dissolved in ink are combined with the air in the buffer chambers 4, forming buffer spillover bubbles.

As shown in FIG. 5A, if the air in the buffer chambers 4 protrudes out of the openings 5 into the liquid chamber 7, and if the amount thereof gradually increases, the air reaches the discharge port row 2*a* and blocks the discharge ports 2*b*, causing non-discharge.

To prevent such a situation, the buffer spillover bubbles are removed before the buffer spillover bubbles block the discharge ports 2*b*. When the buffer spillover bubbles are removed, the air in the buffer chambers 4 needs to be left to keep the meniscus vibration suppressed.

Therefore, it is desirable that the air in the buffer chambers 4 and the buffer spillover bubbles be separated at the openings 5, and the buffer spillover bubbles be discharged.

Figure 7A:
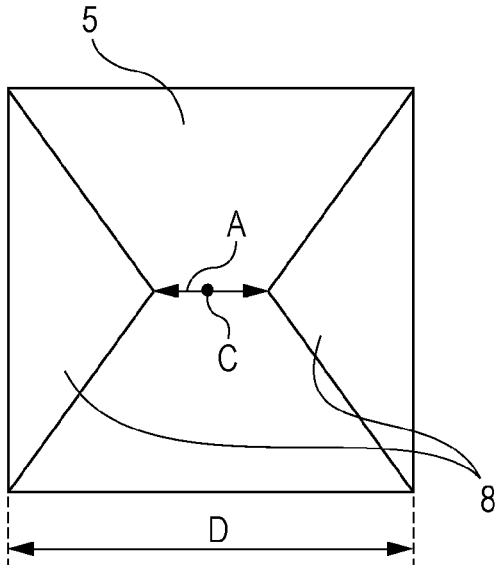
FIGS. 7A and 7B are sectional views showing the inside structure of a liquid discharge head according to the first embodiment of the present invention.

FIG. 7A shows the opening 5 according to this embodiment. As shown in FIG. 7A, the shape of the opening 5 according to this embodiment is a variation of a square, in which two projecting portions 8 project toward the center C of the opening 5. This configuration makes the buffer spillover bubbles grow in a ball shape, starting from a gap A between the projecting portions 8 in FIG. 7A. The sectional area of the portion where the air in the buffer chamber 4 and the buffer spillover bubbles are joined (hereinbelow referred to as a "spillover-bubble sectional area") is smaller than the area of the opening 5. When the buffer spillover bubbles are separated from the opening 5 by using the force of an ink flow, the force needed for separation is smaller if the spillover-bubble sectional area is smaller.

Because the projecting portions 8 in the opening are provided to reduce the spillover-bubble sectional area, one projecting portion 8 is enough to obtain the advantage of the present invention. Therefore, at least one projecting portion 8 projecting toward the inner side of the opening 5 may be provided at the opening 5. Furthermore, the projecting portion 8 may project toward somewhere other than the center C of the opening 5.

Figure 7B:
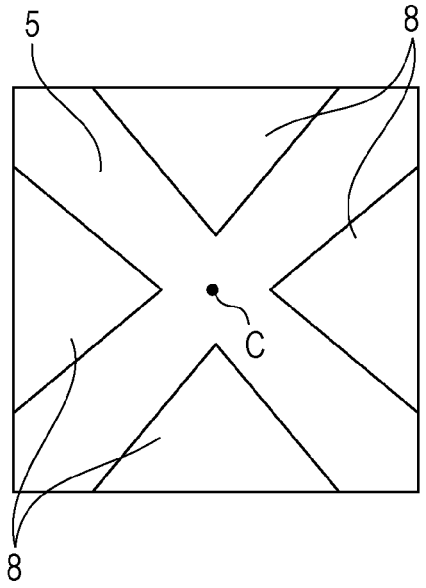

Furthermore, as shown in FIG. 7B, by providing two more projecting portions 8 at the opening 5, the spillover-bubble sectional area can be more stably reduced. Thus, it is possible to more stably separate the buffer spillover bubbles from the opening 5 by using the force of an ink flow. The number of projecting portions 8 added may be any integer greater than one.

Next, the operation for separating the buffer spillover bubbles from the opening 5 will be described.

In this embodiment, the gap A between the projecting portions 8 is smaller than the wall-to-wall distance, D, of the buffer chamber 4, and hence, as shown in FIG. 5A, the buffer spillover bubbles tend to form a ball shape, starting from the gaps A between the projecting portions 8. Therefore, when the buffer spillover bubbles are subjected to ink flows, as shown in FIG. 5B, the buffer spillover bubbles are easily separated from the air in the buffer chambers 4, as shown in FIG. 5C.

For example, flows generated by a suction recovery operation, which is performed to suppress clogging of the discharge ports 2*b* with ink by sucking the ink in the discharge ports 2*b* when the discharge is stopped, are used to separate and discharge the buffer spillover bubbles.

When the buffer spillover bubbles are separated by using ink flows generated by the suction recovery operation, the directions of the ink flows in the vicinity of the openings 5 are, mainly, the directions oriented from the inflow port 14 to the surface 7*a*, along the surfaces 7*b* (hereinbelow referred to as "main directions"). Therefore, the ink flows in the vicinity of the openings 5 are less likely to become irregular or attenuated when the spaces, in the main directions, at the openings 5 are smaller.

In this embodiment, as shown in FIGS. 3 and 4, at each opening 5, one of the two projecting portions 8 projects in the main direction, and the other of the two projections 8 projects in the direction opposite to the main direction. In other words, one of the two projecting portions 8 projects in the direction oriented from the inflow port 14 to the opening 5, and the other of the two projecting portions 8 projects in the direction oriented from the opening 5 to the inflow port 14. Thus, the spaces, in the main directions, at the openings 5 are the gaps A, which are the minimum distance between the two projecting portions 8. Therefore, the ink flows in the vicinity of the openings 5 are less likely to be attenuated, and hence, the buffer spillover bubbles may be easily separated from the air in the buffer chambers 4.

In the suction recovery operation, it is desirable that the ink present in the end regions of the liquid chamber 7 (more specifically, in the liquid chamber 7, portions 71 farther from the inflow port 14 than the openings 5) be discharged or partially heated before suction. By doing so, the viscosity of ink in these portions decreases, improving the flowability of ink. If the flowability of ink at these portions is improved, the ink easily flows along the openings 5, making the separation and recovery of the buffer spillover bubbles even more easy. Furthermore, it is desirable that the projecting portions 8 have angled ends, as such a configuration allows the bubbles to be more easily separated.

Comparative Example

Figure 6:
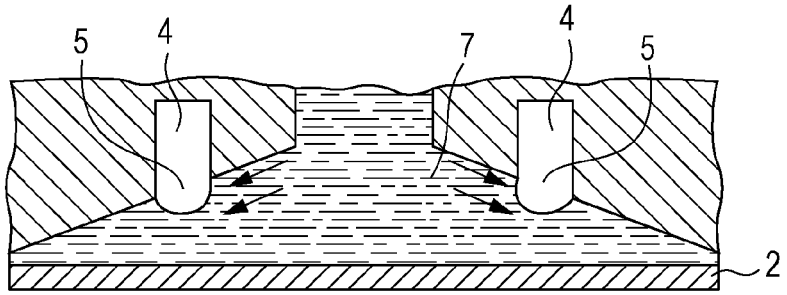
FIG. 6 is a sectional view showing the inside structure of a liquid discharge head according to a comparative example.

FIG. 6 shows, as a comparative example, a sectional view of a liquid chamber 7 having no projecting portions 8 at the openings 5. In this configuration, because the openings 5 are not provided with projecting portions that form boundaries between the air in the buffer chambers 4 and the buffer spillover bubbles, the buffer spillover bubbles are integrated with the air in the buffer chambers 4 and are less likely to form a ball shape. Therefore, the force of ink flows needed to separate and discharge the buffer spillover bubbles increases relative to the amount of buffer spillover bubbles, and the ink flow rate needed for separation and discharge increases. Thus, compared with the first embodiment, separation of the buffer spillover bubbles is difficult, and the possibility of the occurrence of non-discharge is high.

Second Embodiment

Using FIGS. 8A to 9B, a second embodiment of the present invention will be described. The second embodiment differs from the first embodiment in the shape of the openings 5.

FIGS. 8A to 9B are schematic diagrams showing the shapes of the openings 5 according to the second embodiment, which are alternatives to the opening 5 shown in FIG. 7A.

Figure 8A:
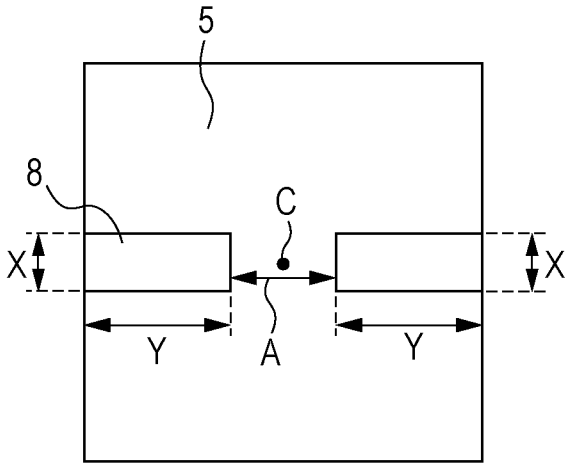
FIGS. 8A and 8B are sectional views showing the inside structure of a liquid discharge head according to a second embodiment of the present invention.
Figure 8B:
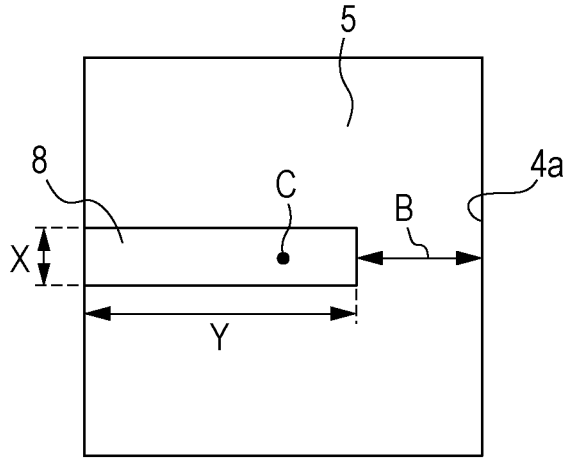
Figure 9A:
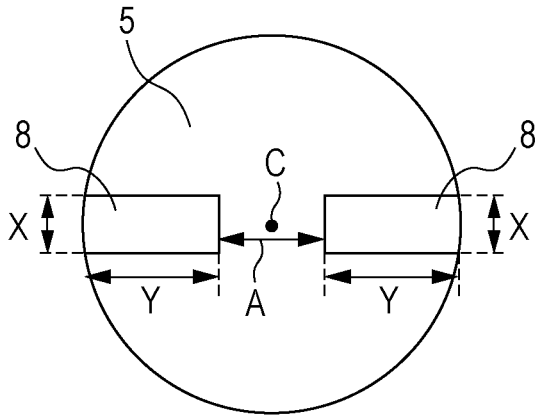
FIGS. 9A and 9B are sectional views showing the inside structure of the liquid discharge head according to the second embodiment of the present invention.
Figure 9B:
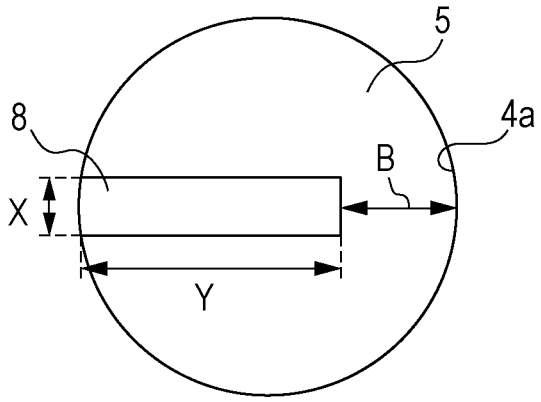

The shape of the opening 5 shown in FIGS. 8A and 8B is a variation of a square, and the shape of the opening 5 shown in FIGS. 9A and 9B is a variation of a circle.

The openings 5 shown in FIGS. 8A and 9A each have two projecting portions 8 projecting toward the center C of the opening 5. The openings 5 shown in FIGS. 8B and 9B each have one projecting portion projecting beyond the center C of the opening 5.

In the projecting portions 8 according to this embodiment, the relationship between the lengths, Y, of the projecting portions 8 in the direction in which they project and the lengths, X, of the projecting portions 8 in the width direction is Y>X. The projecting portions 8 may project either in the main directions or the directions opposite thereto.

In general, larger buffer chambers 4 suppress more meniscus vibration. This also applies to the area of the gas-liquid interface at the opening 5 in a state without the buffer spillover bubbles, and, the larger the area of the opening 5 is, the more meniscus vibration is suppressed. Meanwhile, when the gap A between the projecting portions 8 in the opening 5 or a gap B between the projecting portion 8 and a wall 4*a* of the buffer chamber 4 is smaller, the ink flow rate needed to separate and discharge the buffer spillover bubbles is smaller.

In this embodiment, because the relationship between the length Y of the projecting portion 8 in the direction in which it projects and the length X of the projecting portion 8 in the width direction is Y>X, it is possible to increase the area of the opening 5 by reducing the area of the projecting portion 8, while narrowing the gaps A and B shown in FIGS. 8A to 9B. Hence, it is possible to separate and discharge buffer spillover bubbles, while suppressing the meniscus vibration even more.

Note that, at an initial stage of the movement of the buffer spillover bubbles by an ink flow, narrower ends of the projecting portions 8 (i.e., smaller contact areas between the buffer spillover bubbles and the end regions of the projecting portions 8) make the buffer spillover bubbles move more easily. Hence, it is desirable to make the ends of the projecting portions 8 narrow.

Third Embodiment

Figure 10:
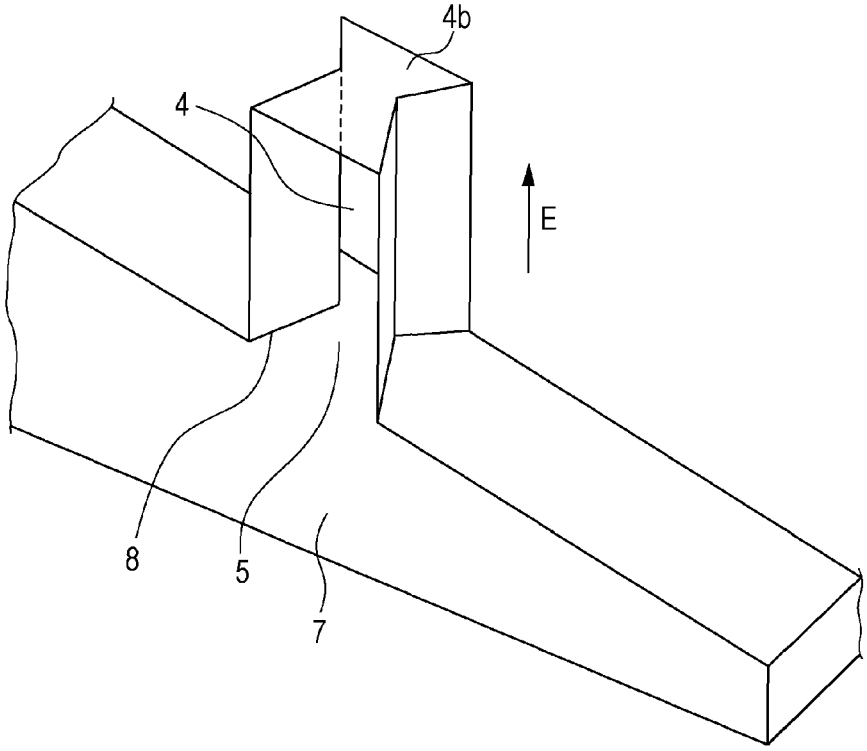
FIG. 10 is a sectional view showing the inside structure of a liquid discharge head according to a third embodiment of the present invention.

Referring to FIG. 10, a third embodiment of the present invention will be described.

FIG. 10 is a sectional perspective view of the buffer chamber 4 and the vicinity thereof in the support member 10. As shown in FIG. 10, the projecting portions 8 extend in the depth direction, E, of the buffer chamber 4.

Although this embodiment is the same as the first embodiment in that the opening 5 of the buffer chamber 4 has the projecting portions 8, the sectional shape of the buffer chamber 4 parallel to the surface 7*b* is unchanged to a top surface 4*b* of the buffer chamber 4. Because larger buffer chambers 4 suppress more meniscus vibration, the vibration suppressing effect achieved in this embodiment is smaller than the first embodiment. However, from the standpoint of the ease of stamping in the manufacturing process, this embodiment is advantageous.

Fourth Embodiment

A fourth embodiment of the present invention will be described using FIG. 11.

Figure 11:
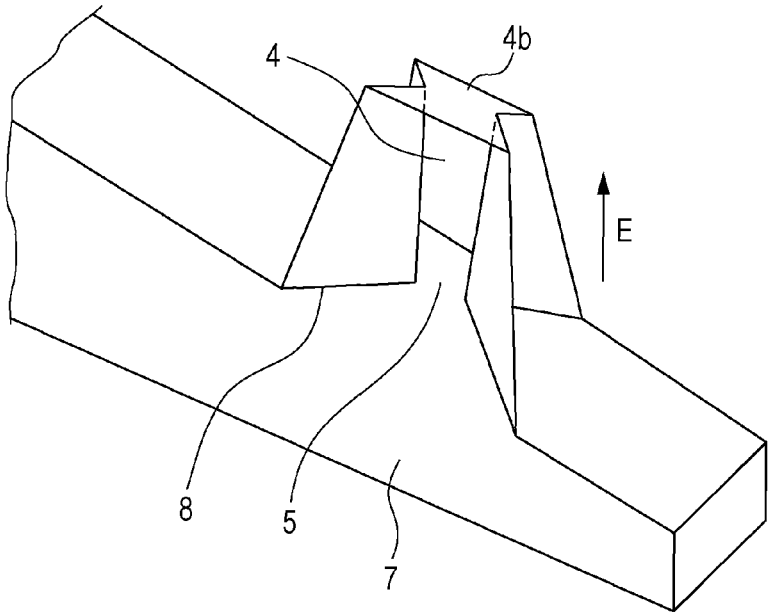
FIG. 11 is a sectional view showing the inside structure of a liquid discharge head according to a fourth embodiment of the present invention.

FIG. 11 is a sectional perspective view of the buffer chamber 4 and the vicinity thereof in the support member 10. As shown in FIG. 11, the projecting portions 8 extend in the depth direction E of the buffer chamber 4. Furthermore, the buffer chamber 4 becomes smaller as the distance from the surface 7*b* increases in the depth direction E of the buffer chamber 4.

Although the shape of the buffer chamber 4 according to this embodiment is similar to the buffer chamber 4 according to the third embodiment, the sectional area of the buffer chamber 4 parallel to the surfaces 7*b* gradually decreases toward the top surface 4*b* of the buffer chamber 4. This configuration may be more advantageous than the third embodiment, from the standpoint of the ease of stamping in the manufacturing process. Furthermore, because the gap A between the projecting portions 8 in the opening 5 is maintained, the same advantage as the first embodiment may be obtained, from the standpoint of separation of the buffer spillover bubbles.

Fifth Embodiment

Figure 12:
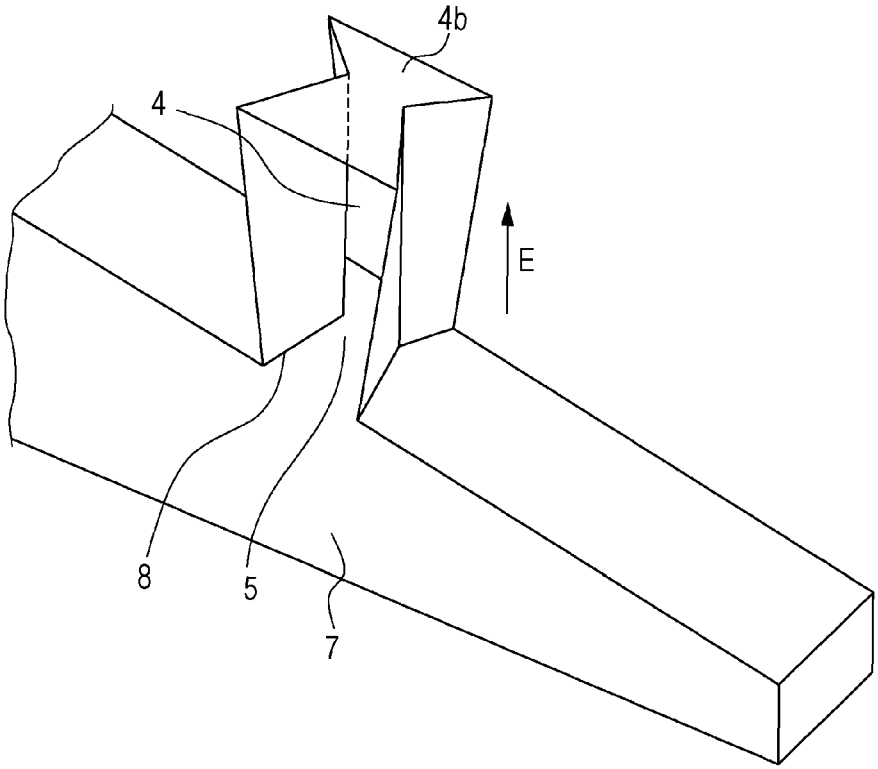
FIG. 12 is a sectional view showing the inside structure of a liquid discharge head according to a fifth embodiment of the present invention.

Referring to FIG. 12, a fifth embodiment of the present invention will be described.

FIG. 12 is a sectional perspective view of the buffer chamber 4 and the vicinity thereof in the support member 10. As shown in FIG. 12, the projecting portions 8 extend in the depth direction E of the buffer chamber 4. Furthermore, the buffer chamber 4 becomes larger as the distance from the surface 7*b* increases in the depth direction E of the buffer chamber 4.

In this embodiment, the sectional area of the buffer chamber 4 parallel to the surface 7*b* gradually decreases from the top surface 4*b* toward the opening 5. Because the area of the opening 5 is small in this configuration, it is advantageous from the standpoint of separation of the buffer spillover bubbles. Furthermore, because the air in the buffer chamber 4 is less likely to escape from the buffer chamber 4, the air retention property of the buffer chamber 4 is good.

Although the meniscus-vibration suppressing effect obtained in this embodiment is smaller than that in the third embodiment shown in FIG. 10 because the area of the opening 5 is reduced, the volume of the buffer chamber 4 is substantially maintained. Thus, a sufficient meniscus-vibration suppressing effect can be obtained.

Sixth Embodiment

Figure 13:
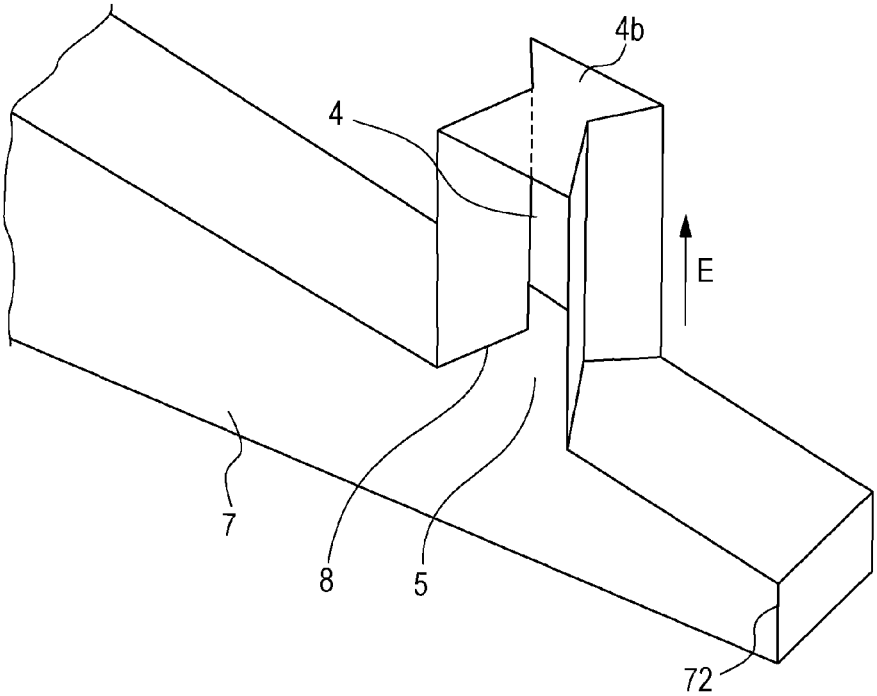
FIG. 13 is a sectional view showing the inside structure of a liquid discharge head according to a sixth embodiment of the present invention.

Referring to FIG. 13, a sixth embodiment of the present invention will be described.

FIG. 13 is a sectional perspective view of the buffer chamber 4 and the vicinity thereof in the support member 10. As shown in FIG. 13, the projecting portions 8 extend in the depth direction E of the buffer chamber 4.

In this embodiment, the buffer chambers 4 are formed at positions closer to the ends 72 of the liquid chamber 7.

When the liquid chamber 7 is formed such that the distance between the surface 7*a* and the surfaces 7*b* decreases toward the ends 72, the period at which the vibrations of ink in the liquid chamber 7 are reflected at the wall of the liquid chamber 7 decreases at positions closer to the ends 72. Therefore, the meniscus vibration, and consequently, the discharge irregularity, is more likely to occur in the discharge ports closer to the ends 72.

As in this embodiment, by forming the buffer chambers 4 at positions closer to the ends 72 of the liquid chamber 7, the meniscus-vibration suppressing effect achieved by the buffer chambers 4 can be more reliably obtained.

In the above-described embodiments, the illustrated configurations are merely examples, and the present invention is not limited to such configurations.

The present invention can reduce the meniscus vibration at the discharge ports and thus can reduce the defective discharge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-146459, filed Jul. 24, 2015, which is hereby incorporated by reference herein in its entirety.

What is claimed is:

1. A liquid discharge head comprising:

a print element substrate provided with discharge ports, through which liquid is discharged; and a support member having a liquid chamber, which is provided with a communicating opening that communicates with the discharge ports, wherein the liquid chamber has a first surface provided with the communicating opening, and a second surface facing the first surface, the second surface is provided with a buffer chamber, which is a hollow space for storing gas, and the buffer chamber has, in the second surface, an opening having a projecting portion projecting toward the inner side of the opening.

2. The liquid discharge head according to claim 1, wherein the projecting portion projects toward the center of the opening or projects beyond the center of the opening.

3. The liquid discharge head according to claim 1, wherein the second surface is provided with a liquid inlet, and the distance between the second surface and the first surface decreases as the distance from the inflow port increases toward an end of the liquid chamber.

4. The liquid discharge head according to claim 3, wherein the projecting portion projects in the direction oriented from the inflow port to the opening or the direction oriented from the opening to the inflow port.

5. The liquid discharge head according to claim 1, wherein the length of the projecting portion in the width direction is smaller than the length of the projecting portion in the direction in which the projecting portion projects.

6. The liquid discharge head according to claim 1, wherein the projecting portion extends in the depth direction of the buffer chamber.

7. The liquid discharge head according to claim 1, wherein the buffer chamber becomes smaller as the distance from the second surface increases in the depth direction of the buffer chamber.

8. The liquid discharge head according to claim 1, wherein the buffer chamber becomes larger as the distance from the second surface increases in the depth direction of the buffer chamber.

9. The liquid discharge head according to claim 1, wherein a portion of the opening is narrowed in the width direction, which is perpendicular to the longitudinal direction of the liquid chamber.

10. A liquid discharge head comprising:

a print element substrate provided with discharge ports, through which liquid is discharged; and a support member configured to support the print element substrate, the support member having a liquid chamber that stores liquid to be supplied to the print element substrate, and a buffer chamber that has an opening communicating with the liquid chamber and that stores bubbles inside, wherein the buffer chamber has an opening having a projecting portion projecting toward the inner side of the opening.

11. The liquid discharge head according to claim 10, wherein the length of the projecting portion in the width direction is smaller than the length of the projecting portion in the direction in which the projecting portion projects.

12. The liquid discharge head according to claim 10, wherein the projecting portion extends in the depth direction of the buffer chamber.

13. The liquid discharge head according to claim 10, wherein the projecting portion has an angled end.

* * * * *